United States Patent [19]

Asai et al.

[11] Patent Number: 4,654,264

[45] Date of Patent: Mar. 31, 1987

[54] METHOD OF SIZING CARBON FIBER AND A CARBON FIBER COMPOSITION

[75] Inventors: Hajime Asai; Katsumi Anai, both of Hiroshima, Japan

[73] Assignee: Mitsubishi Rayon Co., Ltd., Tokyo, Japan

[21] Appl. No.: 873,052

[22] Filed: Jun. 4, 1986

Related U.S. Application Data

[63] Continuation of Ser. No. 734,645, May 16, 1985.

[30] Foreign Application Priority Data

May 16, 1984 [JP] Japan ..... 59-98236

[51] Int. Cl.[4] ..... B32B 9/00

[52] U.S. Cl. ..... 428/367; 549/560; 568/609; 106/287.22; 106/287.26

[58] Field of Search ..... 523/402; 528/87; 549/560; 568/609; 106/287.22; 428/367

[56] References Cited

U.S. PATENT DOCUMENTS

| | | | |
|---|---|---|---|
| 3,123,561 | 3/1964 | Rue | 528/87 X |
| 3,522,210 | 7/1970 | Sellers et al. | 528/93 X |
| 3,914,504 | 10/1975 | Weldy | 428/367 |
| 4,145,472 | 3/1979 | Spain et al. | 428/367 |
| 4,316,991 | 2/1982 | Speranza et al. | 528/103 X |
| 4,517,245 | 5/1985 | Spain | 428/367 |

*Primary Examiner*—Earl Nielsen

*Attorney, Agent, or Firm*—Sughrue, Mion, Zinn, Macpeak and Seas

[57] ABSTRACT

A sizing agent for use with carbon fibers is described, comprising a compound of formula (I)

(I)

wherein R is —OH or n is 8 to 100, preferably 10 to 50.

7 Claims, 4 Drawing Figures

METHOD OF SIZING CARBON FIBER AND A CARBON FIBER COMPOSITION

This is a continuation of application Ser. No. 734,645, filed May 16, 1985.

FIELD OF THE INVENTION

The present invention relates to a novel sizing agent for use with carbon fibers and graphite fibers.

BACKGROUND OF THE INVENTION

Carbon fibers have small ductility and are relatively brittle, so they easily become fuzzy as a result of mechanical friction. In order to improve their handling properties, carbon fibers are usually sized. As sizing agents for use with carbon fibers, polyglycidyl ether (described in Japanese Patent Publication No. 15229/82) and various other compounds have been proposed.

Thus, the primary function of the sizing agent is to prevent any mechanical damage to the tow, thereby maintaining the strength properties of the carbon fibers, and improving its handling. Our extensive studies on carbon fibers have revealed that carbon fibers having uneven and striated surfaces are disintegrated fairly easily and cannot be bundled to form a tow having high alignment. In order to prevent the formation of excessive fuzzs and to improve the handling of the tow, such carbon fibers must be sized to have a surface coat of a viscous oligomer having a relatively high molecular weight. On the other hand, carbon fibers having smooth surfaces can be easily bundled into a tow having good handling properties. Therefore, such carbon fibers need not be sized but may only have to be wetted with water for proper operation of the subsequent steps. If a viscous oligomer coat is formed on such smooth surfaced carbon fibers, the individual fibers are bundled so tightly as to reduce the spreadability of the resulting tows. This will cause various problems in subsequent operations, such as insufficient impregnation of the fibers with the matrix resin in the prepregging step. Another characteristic feature of the smooth surfaced carbon fibers is that the slightest change in the deposition of the size will cause great variations in the bundling property of the fibers and the spreadability of the tows.

It is therefore important that sizing agents of different characteristics should be used depending upon the surface properties of the carbon fibers to be treated. From an industrial viewpoint, it is desired to develop a size that has a broad working range and which will not cause great variations in the bundling property or tow spreadability even if there occurs a certain change in the amount of the size being deposited.

The secondary function of the size is to control the characteristics of interface between the carbon fibers and the matrix resin in a composite. A common matrix resin is an epoxy resin but if a silicone resin oligomer is used as a size, for instance, the strength of the interface between the resin and the carbon fibers is remarkably decreased and the desired composite is not obtainable. This is probably because the silicone resin has poor solubility with the epoxy resin. In most practical applications, epoxy resin oligomers are used as the sizing agent and it is generally understood that good interface strength is ensured since the size at the interface between the matrix epoxy resin and the carbon fibers is simultaneously cured by the curing agent in the matrix resin. As shown in J. Adhesion, 16, 133, 1983 and the Proc. of the 38th Ann. Conf. of SPI. Sec. 12-F, 1983, the composite forming properties of the carbon fibers could be improved by making use of the ability of the size to increase the adhesion strength at the interface between the fibers and the matrix resin. However, it is also important to maintain the good spreadability of individual tows of carbon fibers and considerable difficulties exist in obtaining good balance between the bundling and spreading properties of the fibers. In fact, most of the conventional sizing agents have been developed with a view to maximizing the bundling property of the carbon fibers without impairing their composite properties.

The conventional sizing agents are classified into two types: the solution type using an organic solvent and the emulsion type having the size dispersed in water with the aid of an emulsifier. One major defect with the size of the solution type is that the organic solvent which can cause void formation must be completely removed with heat during the fabrication of a composite. For this reason, the solvents that can be used are restricted to those which boil at low temperatures, such as methyl ethyl ketone and alcohol. Additionally, the prerequisite for the use of organic solvents is the provision of special facilities that will ensure maximum safety and protection against both health hazards and environmental pollution. Furthermore, only limited types of sizing agents are dissolvable in the usable solvents. These problems are absent from the sizing agent of the emulsion type, as was already proposed by the present inventors in Japanese Patent Application (OPI) No. 171767/82 (the term "OPI" as used herein refers to a "published unexamined Japanese patent application open to public inspection"). However, most of the epoxy resin oligomers are not easily emulsifiable and because of their high degree of instability, scum easily forms in the emulsions. An emulsion of the epoxy resin oligomer could be formed by using a great amount of emulsifier, but this is detrimental to the purpose of providing good composite properties and a sizing agent with a high content of the emulsifier cannot be uniformly deposited on the carbon fibers. With all these factors taken into consideration, a water-soluble size would be the best material. On the basis of this recognition, the present inventors conducted studies on the water-soluble epoxy resins, and proposed the use of a polyol polyglycidyl ether in Japanese Patent Application (OPI) No. 128266/82.

However, later studies have revealed that a composite made from carbon fibers sized with this polyol polyglycidyl ether is poor in its hot wet properties. A probable reason for this phenomenon would be that polyol polyglycidyl ethers have such low molecular weights that they are extremely soluble in water.

SUMMARY OF THE INVENTION

The principal object of the present invention is to provide a new water-soluble sizing agent for use with carbon fibers that is capable of improving the propensity of the fibers to be bundled into a tow that exhibits good handling properties in the enhanced processing.

DETAILED DESCRIPTION OF THE INVENTION

Figure 1:
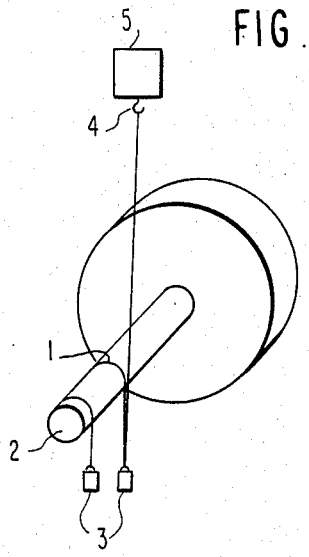
FIG. 1 is a device to measure the frictional coefficient (against mirror-surfaced chronium plate) in the examples.

The sizing agent for use with carbon fibers in accordance with the present invention has a compound of formula (I) as the main component and is either dissolved or dispersed in water:

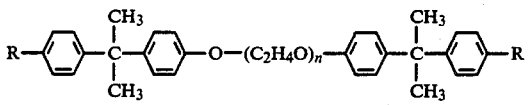

(I)

wherein R is —OH or

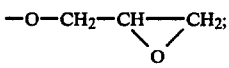

n is 8 to 100, preferably 10 to 50.

A hydroxyl or glycidyl group is selected as R because of its good miscibility and reactivity with an epoxy resin.

The sizing agent of the present invention is of the self-emulsifiable type and has the ability to emulsify the epoxy resin. Therefore, in accordance with the present invention, the compound of formula (I) can be blended with the epoxy resin. The epoxy resin is generally selected from among bisphenol A type diglycidyl ethers typified by Epikote 828 (the trademark of Yuka Shell Co., Ltd. for an epoxy resin), but other suitable epoxy resins include polyfunctional epoxy resins such as tetraglycidyl diaminodiphenylmethane and novolak type epoxy resins, as well as monoglycidyl compounds. In order to provide carbon fibers having flexibility and good balance between the bundling and spreading properties, viscous oligomers that are flowable at room temperature (viscosity: 10 to 1,000 poises at 25° C.) are preferably used as epoxy resins, and such oligomers are desirably used in amounts not exceeding the weight of the compound of formula (I). As the proportion of the epoxy resin is increased, the propensity of the carbon fibers to be bundled into a tow is increased, thereby decreasing the flexibility of the fibers.

In accordance with one feature of the present invention, the sizing agent described above is used as a solution or dispersion in water. The higher the viscosity and proportion of the epoxy resin, the more heterogeneous the aqueous system becomes, thereby increasing the chance of separation into two layers. For the purpose of the present invention, the size is preferably dissolved or dispersed in water as uniformly as possible; for example, the desired aqueous system of the size has such a turbidity that it transmits at least 10% of the light having a wavelength of 560 to 570 nm. In order to satisfy these requirements, the epoxy resin to be mixed in the size of the present invention should have a viscosity in the range of 10 to 1,000 poises at 25° C. and should not be used in a proportion exceeding 50% of the mixture.

The size of the present invention provides a protective coat on carbon fibers or graphite fibers, which are then processed into bodies of revolution by filament winding or fabricated into prepreg cloth. Whichever the use of the carbon or graphite fibers, the deposition of the size should be in the range of 0.1 to 5.0 wt % and the effective component should be uniformly deposited on the fibers. These requirements must be met by proper control over the concentration and temperature of the sizing bath, as well as the tension rate in the sizing step.

The following examples are provided by way of further illustrations of the present invention and should not be construed as limiting.

EXAMPLE 1

Carbon fiber filaments (Pyrofil T-1, the trademark of Mitsubishi Rayon Company Limited, 12,000 fil., unsized) were sized with a 1% aqueous solution of bisphenol A of formula (I) wherein R=—OH and n=30 (added with 30 moles of polyethylene oxide).

The fibers were thoroughly immersed in the aqueous solution and, after removing excess size by passage through squeeze rollers, the fibers were dried in air at 110° C. for 1 minute. The size deposit was 0.61%. The sized fibers had the characteristics shown in Table 1.

EXAMPLE 2

The carbon fibers used in Example 1 were sized as in Example 1 using a 1% aqueous solution of bisphenol A glycidyl ether of formula (I) wherein R=

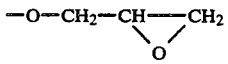

and n=20 (added with 20 moles of polyethylene oxide). The size deposit was 0.57%. The sized fibers had the characteristics shown in Table 1.

EXAMPLE 3

The carbon fibers used in Example 1 were sized as in Example 1 using a vigorously agitated mixture of 100 parts of bisphenol A of formula (I) wherein R=—OH and n=40 (added with 40 moles of polyethylene oxide) and 30 parts of Epikote 828 (the trademark of Yuka Shell Co., Ltd. for an epoxy resin). The dispersoid had a light transmittance of 11% and the size deposit was 0.52%. The sized fibers had the characteristics shown in Table 1.

EXAMPLE 4

The carbon fibers used in Example 1 were sized as in Example 3 with a vigorously agitated mixture of 100 parts of bisphenol A of formula (I) wherein R=—OH and n=40 (added with 40 moles of polyethylene oxide) and 10 parts of Epikote 834 (the trademark of Yuka Shell Co., Ltd. for an epoxy resin). The epoxy resin was uniformly dispersed and the dispersoid had a light transmittance of 18%. The sized fibers had the characteristics shown in Table 1.

EXAMPLE 5

The carbon fibers used in Example 1 were sized as in Example 3 with a vigorously agitated blend of 100 parts of bisphenol A of formula (I) wherein R=—OH and n=40 (added with 40 moles of polyethylene oxide) and 10 parts of a 9:1 mixture of Epikote 827 (the trademark of Yuka Shell Co., Ltd. for an epoxy resin) and Epikote 1001 (the trademark of Yuka Shell Co., Ltd. for an epoxy resin). The epoxy resins were uniformly dispersed and the dispersoid had a light transmittance of 23%. The sized fibers had the characteristics shown in Table 1.

COMPARATIVE EXAMPLE 1

The carbon fibers used in Example 1 were sized as in Example 1 using 1 part of Epikote 834 (the trademark of Yuka Shell Co., Ltd. for an epoxy resin) as dissolved in 100 parts of methyl ethyl ketone. The sized fibers had the characteristics shown in Table 1.

COMPARATIVE EXAMPLE 2

The carbon fibers used in Example 1 were sized as in Example 1 using bisphenol A glycidyl ether of formula (I) wherein R=

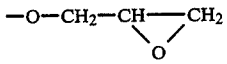

and n=8 to 9 (added with 7 moles of polyethylene oxide). This size was not easily soluble in water and could not be evenly deposited on the fibers. The characteristics of the sized fibers are shown in Table 1.

COMPARATIVE EXAMPLE 3

The carbon fibers used in Example 1 were sized as in Example 1 using bisphenol A glycidyl ether of formula (I) wherein R=

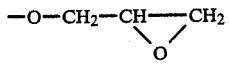

and n=60 (added with 60 moles of polyethylene oxide). The sized fibers were smooth surfaced and were bundled with an undesirably large degree of tightness.

TABLE 1

| Factor | Run No. Example 1 | Example 2 | Example 3 | Example 4 | Example 5 | Comparative Example 1 | Comparative Example 2 |
|---|---|---|---|---|---|---|---|
| Frictional Coefficient (against mirror surfaced chromium plate) | 0.654 | 0.698 | 0.628 | 0.712 | 0.686 | 1.629 | 1.155 |
| Yarn Softness (g) | 4.1 | 4.5 | 4.6 | 5.0 | 4.8 | 6.5 | 5.8 |
| Fuzzing with Abrasion | A | A | A | A | A | B | B |

A: Good Bundling
B: Excessive Bundling

Each value shown in Table 1 was measured and observed by followings.

(1) Frictional Coefficient (against mirror surfaced chromium plate)

As in FIG. 1, the carbon fibers 1 were hung on the cylinder 2. The both ends of carbon fibers were weighted with 100 mg load 3. One end of carbon fibers was hung on the hook 4 torsion balance 5. Then, the cylinder was revolved at 1,800 cm/min, and the values of the torsion balance 5 were measured.

(2) Yarn Softness

Figure 2:
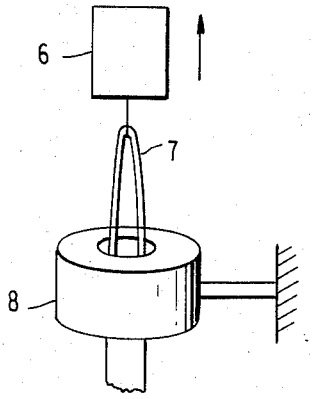
FIG. 2 is a device to measure the yarn softness in the examples.

As in FIG. 2, the values of yarn softness were measured by U-gauge 6 when the carbon fibers 7 were passed through the ring 8.

(3) Fuzzing with Abrasion

Figure 3:
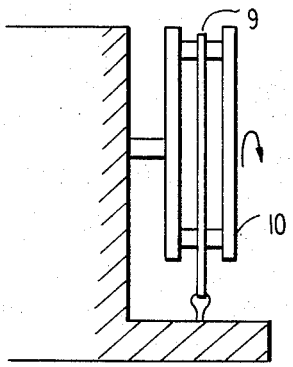
FIGS. 3 and 4 are a device to observe the fuzzing with abrasion in the examples.
Figure 4:
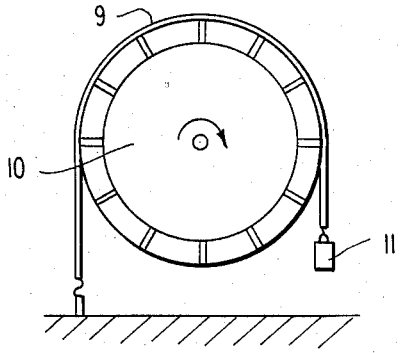

As in FIGS. 3 and 4, the carbon fibers 9 were hung on the pulley 10. One end of carbon fibers was weighted with 150 mg load 11. The pulley 10 was revolved 100 times at one revolution/2 seconds. Then, the bundling of carbon fibers 9 was observed.

While the invention has been described in detail and with reference to specific embodiments thereof, it will be apparent to one skilled in the art that various changes and modifications can be made therein without departing from the spirit and scope thereof.

What is claimed is:

1. A method of sizing carbon fibers comprising coating carbon fibers with a sizing agent comprising a compound of formula (I):

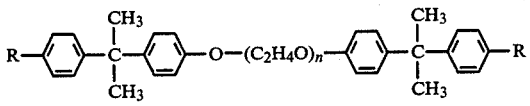

(I)

wherein R is —OH or

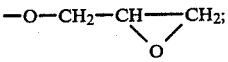

n is 10 to 50.

2. The method of sizing carbon fibers as claimed in claim 1, wherein the compound of formula (I) is mixed with an epoxy resin comprising a bisphenol A type diglycidyl ether.

3. The method of sizing carbon fibers as claimed in claim 2, wherein said epoxy resin has a viscosity of 10 to 1,000 poises at 25° C.

4. The method of sizing carbon fibers as claimed in claim 3, wherein the weight ratio of said epoxy resin to the compound of formula (I) is not greater than 1.

5. The method of sizing carbon fibers as claimed in claim 4, wherein the size is used as an aqueous system wherein the size is either dissolved or dispersed in water.

6. The method of sizing carbon fibers as claimed in claim 5, wherein the aqueous system of the size transmits at least 10% of light having a wavelength of 560 to 570 nm.

7. A carbon fiber composition comprising carbon fibers coated with a sizing agent comprising a compound of formula (I):

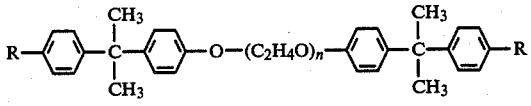

(I)

wherein R is —OH or

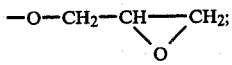

n is 10 to 50, wherein the amount of said sizing agent coated on said carbon fibers is 0.1 to 5.0 wt %.

* * * * *